US006257147B1

(12) United States Patent
Davies

(10) Patent No.: US 6,257,147 B1
(45) Date of Patent: Jul. 10, 2001

(54) FRANGIBLE SHOTSHELL

(76) Inventor: Robert Bruce Davies, 433 E. McKinley, Tempe, AZ (US) 85281

( * ) Notice: Subject to any disclaimer, the term of this patent is extended or adjusted under 35 U.S.C. 154(b) by 0 days.

(21) Appl. No.: 09/305,348

(22) Filed: May 3, 1999

(51) Int. Cl.[7] ..... F42B 12/56
(52) U.S. Cl. ..... 102/439; 102/449; 102/506
(58) Field of Search ..... 102/438, 439, 102/447–463, 501, 506, 517, 518, 522, 532

(56) References Cited

U.S. PATENT DOCUMENTS

| | | | | |
|---|---|---|---|---|
| 347,051 | * | 8/1886 | Libbey | 102/462 |
| 579,853 | * | 3/1897 | Williams | 102/453 |
| 889,644 | * | 6/1908 | Szemerey | 102/449 |
| 3,074,344 | * | 1/1963 | Devaux | 102/460 |
| 3,179,051 | * | 4/1965 | Morse | 102/452 |
| 3,180,265 | * | 4/1965 | Rubak | 102/451 |
| 3,208,382 | * | 9/1965 | Foot et al. | 102/453 |
| 3,516,360 | * | 6/1970 | Lathrope et al. | 102/451 |
| 3,575,113 | * | 4/1971 | Ashbrook et al. | 102/451 |
| 3,952,658 | * | 4/1976 | Broyles | 102/448 |
| 4,907,488 | | 3/1990 | Seberger | 89/14.4 |
| 5,293,822 | * | 3/1994 | Peddie | 102/506 |
| 5,402,729 | * | 4/1995 | Richert | 102/439 |
| 5,476,028 | | 12/1995 | Seberger | 89/14.3 |
| 5,822,904 | * | 10/1998 | Beal | 102/430 |

* cited by examiner

*Primary Examiner*—Harold J. Tudor
(74) *Attorney, Agent, or Firm*—Parsons & Goltry; Robert A. Parsons; Michael W. Goltry

(57) ABSTRACT

A method and an apparatus for suppressing muzzle blast, muzzle crack and/or over penetration in a weapon. A frangible shotshell payload comprising a cup having a portion divided into petals, a payload having a mass disposed in the cup and a cap disposed at, and melted into, tips of the petals. The frangible shotshell may include a cup or wad formed from high density polyethylene. The cap may be formed from a disc of low density polyethylene having a diameter of 0.625".

13 Claims, 7 Drawing Sheets

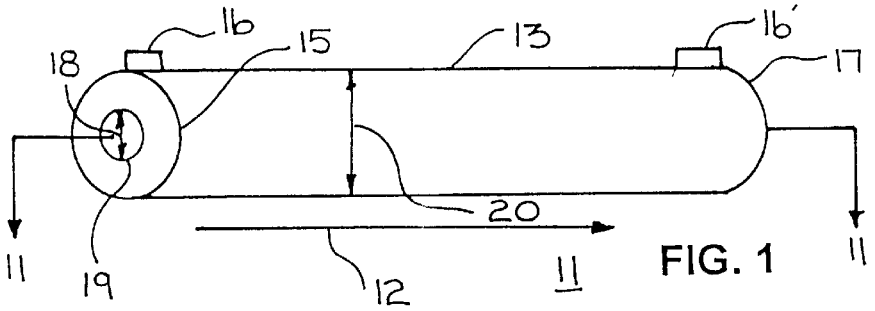
FIG. 1
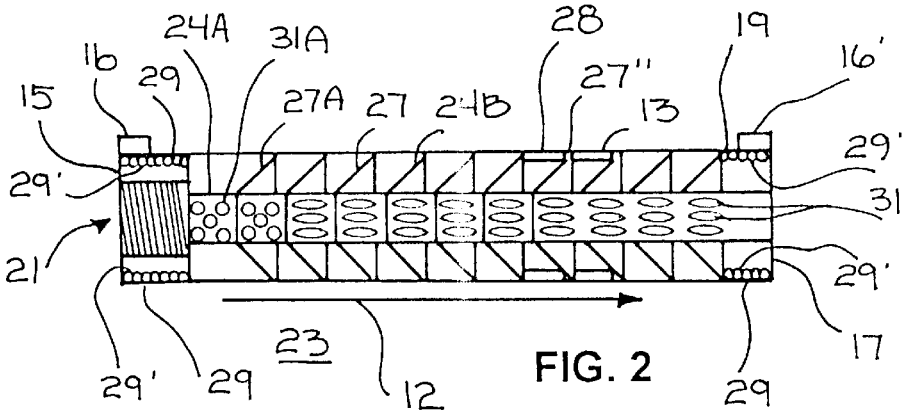
FIG. 2
FIG. 3A
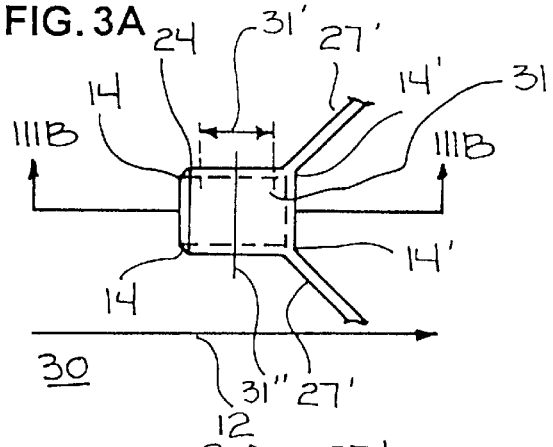
FIG. 3B
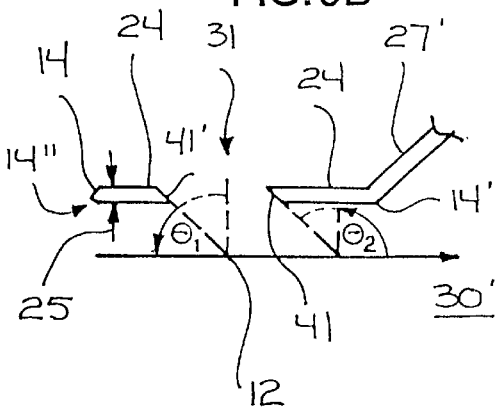
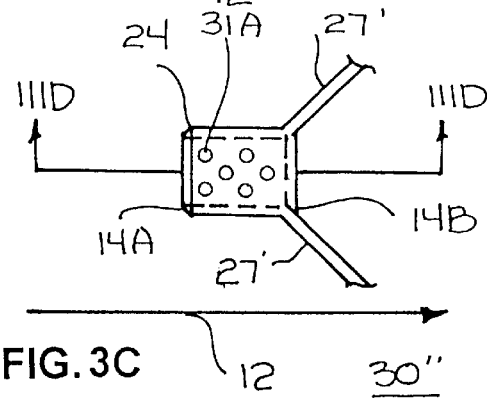
FIG. 3C
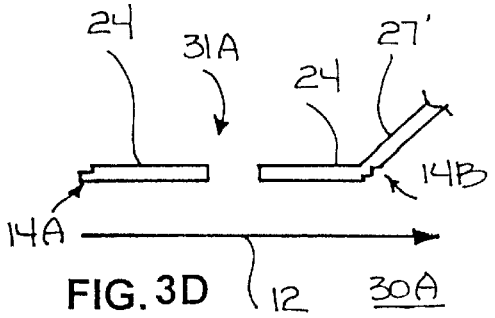
FIG. 3D

FRANGIBLE SHOTSHELL

BACKGROUND OF THE INVENTION

1. Field of the Invention

This invention relates to a method, apparatus and system for suppression of over-penetration in small arms.

More particularly, the present invention relates to suppression of spreading in shot load projectiles fired from weapons such as shotguns.

In a further and more specific aspect, the instant invention concerns a method and apparatus for suppressing muzzle blast and/or muzzle crack in weapons deploying shot loads.

2. Prior Art

In operation of small arms, it is known that it may be desirable to suppress muzzle jump and/or recoil. Muzzle jump and recoil both stem from the inherent physics of rapidly propelling a mass, via deflagration of a propellant, from the chamber of the through the barrel and out of the muzzle, through Sir Isaac Newton's law of physics that states "For every action, there shall be an equal and opposite reaction". These phenomena may be undesirable because they tend to (i) reduce accuracy of the shot and (ii) fatigue the person operating the weapon.

One approach to reducing perceived recoil and/or muzzle jump phenomena as well as to increase accuracy is to provide one or more, and usually many, ports exiting from near the muzzle end of the weapon. This has the effects of distributing the escape of burning gases over time, reducing the temporal impact of the recoil, and of re-directing the dispersal of the gasses in chosen directions, reducing and/or directing the impact of the recoil along the long axis of the weapon. However, this does relatively little towards reducing the muzzle blast and/or muzzle crack resulting from discharge of the weapon.

These types of adaptations are marketed by, among other gunsmiths, Pro-port® Limited (41302 Executive Drive, Harrison Township, Mich. 48045-1306, telephone number (810) 469-7323). Another type of weapon modification is the provision of chokes on shotguns. All of these have the above-noted advantages but also include risk of damage to the weapon when they are mishandled, because they tend to weaken the barrel of the weapon in the region in which they are installed.

For example, when using a shotgun equipped with ports and a choke, it is generally undesirable to pass a deer slug through the weapon because the normal function of the choke is to compress the projectiles. Deer slugs tend to be relatively incompressible and this likely will result in undue stress being developed in the region of the choke and ports, which may in turn result in fracture of the barrel at the muzzle end.

Muzzle blast is a loud noise or bang that generally accompanies the discharge of a firearm. A variety of techniques have been developed to redirect or eliminate muzzle blast for some types of small arms. These devices generally fall into two categories, known as (i) muzzle brakes and flash hiders and (ii) suppressors or silencers.

Flash hiders tend to constrict the path of the escaping, burning gasses, reducing the field of view from which the muzzle flash is readily visible. Muzzle brakes may be employed to counter muzzle climb or muzzle jump, e.g., the famous Cutts compensator employed on the Thompson submachine gun, amongst other weapons. Flash hiders and muzzle brakes do relatively little to ameliorate noise upon discharge of a weapon.

Sound suppressors also modify the path of the escaping gasses, but do so in such as way as to temporally disperse the escape of burnt and/or burning gasses from the muzzle. This has the effect of dispersing over time what otherwise would be a loud bang, in order to provide a much softer noise.

Usually, this requires a series of chambers distributed in a canister that is adapted to be secured to the muzzle of the weapon. The chambers are coupled to the barrel in order to allow deflagrating and burnt gaseous propellants to escape from the barrel into the chambers. The gasses then exhaust from the chambers through the barrel, but they are dispersed and delayed and also are engaged in much more turbulent flow. The objective is to silence the escape of burning or burnt gasses from the muzzle of the weapon. These types of devices often work rather well for small arms that discharge a single projectile such as a bullet.

However, even with a suppressor that is adapted to reduce muzzle blast to levels that would not otherwise require hearing protection devices for operation of the weapon, another phenomenon gives rise to substantial noise upon discharge of weapons employing supersonic ammunition, i.e., ammunition that will result in a projectile traveling at a speed greater than Mach 1 when the weapon is discharged. When the load, projectile or shot is traveling at a speed greater than the speed of sound in air (i.e., $1100^{+}$ feet per second) as the load exits from the muzzle of the weapon, the load or projectile also carries with it and radiates a shock wave or sonic boom. This phenomenon is known as "muzzle crack" and it may also result in substantial noise levels.

Muzzle crack and muzzle blast each generally serve to render operation of a weapon an event likely to be noticed by the person operating the weapon, any persons who are cooperating with the person operating the weapon and any persons who simply happen to be in the vicinity, providing that these various persons are not deaf. Moreover, these events are also likely to suggest to the person operating the weapon and persons cooperating therewith that hearing protection may well be a good idea for avoiding deafness.

Hearing protection tends to inhibit conversation and may increase likelihood of ear infection if the hearing protection extends into the ear canal. Hearing protection devices may also inhibit wearing of a hat for obviating unwanted solar illumination or glare in target shooting. Hearing protection may additionally be a very poor idea in certain types of Special Weapons operations wherein peace officers are attempting to control inherently dangerous situations.

In these types of settings, it is desirable for the peace officer to not only make as little noise as possible in the course of resolving each element of the problem. It is also strongly desirable that the peace officer be able to tell what is going on in the immediate vicinity. Being able to hear sounds of movement may well be critical to the peace officer's continued ability to function effectively. Additionally, in these types of settings, it may well be that accuracy and shot placement not only are important in the short range or over a short distance, it may be extremely desirable to reduce the likelihood of a load or projectile(s) finding an inadvertent target at a greater distance, a problem known as "over penetration".

For example, in attempting to apprehend or neutralize an "armed and dangerous" band of thugs in a crowded apartment building, it is generally undesirable to employ projectiles having lethal capacity after penetration of a multiplicity of walls. These settings call out for a weapon that is not only able to be operated relatively silently and which is also intended to be deadly or at least capable of disabling a human target at short range, but which also is at least less likely to have a long range killing impact or potential. A suppressed shotgun deploying a subsonic shot load would be ideal for many types of Special Weapons operations.

A feature common to suppressed weapons is a means for deploying a projectile without adversely affecting the ability of the operator to place the shot and without suffering the deleterious effects of muzzle blast, muzzle crack, muzzle jump and recoil. Because suppressors include chambers coupled to a length of barrel, they tend to be larger in diameter than the barrel. This tends to interfere with use of sights that are normally coupled to the barrel to enable accurate placement of the shot. Additionally, the added mass and bulk of the suppressor may interfere with rapidly aiming at a specific target. These effects are generally undesirable.

Accordingly, it is desirable, particularly with respect to weapons intended to deploy a shot load, to be able to suppress muzzle blast and/or muzzle while delivering a disabling or lethal load to the intended target without risk of over-penetration.

In order to combat these varied problems, some form of suppressor capable of repeatedly passing a shot load without damage to the weapon or the suppressor or substantial risk of injury from shrapnel arising from explosion of the barrel or suppressor would be highly desirable. It is also highly desirable that the weapon retain short-range accuracy and firepower without incurring undue potential for long-range stray shots having high killing probability.

While the various mentioned prior art devices function as apparatus for suppressing weapons adapted to deploying single, solid projectiles, certain inherent deficiencies preclude adequate, satisfactory performance of the purpose of suppressing weapons adapted to deploying a shot load. One set of experiments with a suppressor that had worked well with deer slugs being deployed from a 12 gauge shotgun left the suppressor looking as though "it had been stung by a swarm of bees" after inadvertent passage of a shot load through the suppressor.

It would be highly advantageous, therefore, to remedy the foregoing and other deficiencies inherent in the prior art.

Accordingly, it is an object of the present invention to provide improvements in suppressors.

Another object of the present invention is the provision of an improved method and apparatus for suppressing muzzle blast in weapons that are intended to deploy a shot load.

An additional object of the instant invention is the provision of an improved method and apparatus for providing reduction in both muzzle blast and muzzle crack in weapons that are intended to discharge a shot load.

Moreover, an object of the instant invention is the provision of an improved method and apparatus for providing reduced risk of over-penetration in deployment of disabling or lethal projectiles.

Still a further additional object of the present invention is to provide an improved method, apparatus and system for reduction of muzzle blast typically experienced in operating shotguns.

And another object of the present invention is to provide an improved method, apparatus and system for reducing recoil and noise levels associated with operation of weapons intended to deploy shot loads while increasing payload efficiency and decreasing over-penetration.

Yet still another object of the instant invention is the provision of a method, system and apparatus for suppressing muzzle blast in small arms.

And a further object of the invention is to provide a method, system and apparatus for suppressing both muzzle blast and muzzle crack in shotguns that can also accommodate repeated shot loads.

Still a further object of the immediate invention is the provision of a method, apparatus and system for reducing noise associated with discharge of a weapon.

And still a further object of the invention is the provision of method and apparatus, according to the foregoing, which is intended to allow operation of a shotgun without incurring muzzle blast or muzzle crack and while providing increased payload efficiency coupled with an improved over-penetration profile.

SUMMARY OF THE INVENTION

Briefly stated, to achieve the desired objects of the instant invention in accordance with an aspect thereof, an apparatus is provided for suppressing muzzle blast from a weapon upon discharge of one or more projectiles therefrom. In one aspect, the present invention includes a shotgun shell comprising a cartridge including a cylindrical outer wall extending the length of the shotgun shell and a base including a primer disposed at. a first end of the cylindrical outer wall, an amount of powder disposed adjacent the primer and wadding disposed adjacent the amount of powder. The wadding includes a cup. A quantity of shot having a mass is disposed in the cup, wherein the amount of powder and the mass are chosen to provide a muzzle velocity of less than Mach 1.

In one aspect, the shot is usefully contained in a plastic or vinyl container. Preferably, the plastic or vinyl container is sealed until the shot and container impacts a target.

The shotgun shell desirably but not essentially further comprises a cap contained in the cylindrical outer wall at an end distal with respect to the first end. The cup includes an opening disposed adjacent the distal end and encircles the shot.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 1 is a simplified, isometric schematic illustration of a first preferred embodiment of a suppressor, in accordance with the teachings of the instant invention;

FIG. 2 is a simplified side view, in section, taken along section lines II—II of FIG. 1, of the first preferred embodiment of the suppressor, in accordance with the teachings of the instant invention;

FIG. 3A is a simplified side view, in section, taken along section lines II—II of FIG. 1, showing details of the first preferred embodiment of the suppressor, in accordance with the teachings of the present invention;

FIG. 3B is a simplified side view, in section, taken along section lines IIIB—IIIB of FIG. 3A, illustrating the preferred range of angles of intersection θ-of the openings with the walls of the barrel segments, in accordance with the teachings of the instant invention;

FIG. 3C is a simplified side view, in section, taken along section lines II—II of FIG. 1, showing details of a second preferred embodiment of the modified barrel segments and a blast plate for the suppressor, in accordance with the teachings of the present invention;

FIG. 3D is a simplified side view, in section, taken along section lines IIID—IIID of FIG. 3C, illustrating a preferred embodiment of the flanges for mating successive barrel segments to one another, in accordance with the teachings of the instant invention;

DETAILED DESCRIPTION OF THE PREFERRED EMBODIMENT

Figure 4:
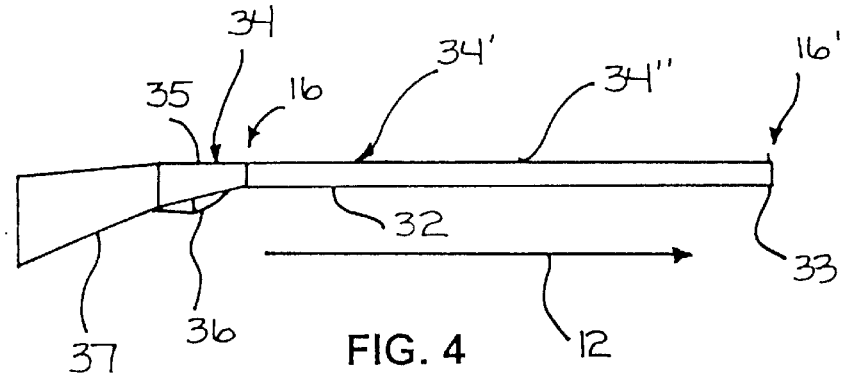
FIG. 4 is a simplified schematic illustration of a shotgun, in accordance with the teachings of the instant invention.

Turning now to the drawings, in which like reference characters indicate corresponding elements throughout the several views, attention is first directed to FIG. 1, which illustrates a simplified, isometric view of a first preferred embodiment of a suppressor, generally designated by the reference character 11, intended for use with a shotgun 40 (see FIG. 4, infra), in accordance with the teachings of the instant invention.

The suppressor 11 includes an outer shell 13 that is usefully generally tubular and that is preferable fashioned from a durable and lightweight material. While steel provides durability, titanium provides durability coupled with light weight and is preferred. Other materials that could usefully be employed in the construction of the outer shell 13 of the suppressor 11 include carbon fiber or graphite, KEVLAR®, aluminum and the like.

The outer shell 13 includes provisions for securing end pieces 15 and 17 thereto, such as arrangements for threadedly engaging end pieces 15 and 17 to the outer shell 13. The end pieces 15 and 17 include openings such as 19, having a diameter or bore 18 that is large enough to admit and pass projectiles (as indicated by direction arrow 12) of the caliber for which the suppressor 11 is adapted to accommodate.

Alternatively, the front end cap 17 and the rear end cap 15 may be secured together with the remainder of the suppressor 11 by passing bolts through holes in the end caps 15 and 17 and through corresponding holes in the baffles 24. The bolts are desirably equispaced about and outside of the bore area, e.g., three bolts spaced 120° apart. The bolts may be hollow, to reduce mass, and are secured by nuts that threadedly engage the bolts and which are tightened until the nuts encounter the outside edges of the end caps 15 or 17. In one embodiment, the bolts are fashioned from one-half inch titanium rod that has been hollowed out to provide a 0.90" wall.

The rear end cap 15 is adapted to be attached to the muzzle end of a weapon, traditionally via internal threads 21 disposed within the bore 18 of the end cap 15 and adapted to accommodate and threadedly engage with external threads (not illustrated) disposed at the muzzle 33 (see FIG. 4) of the weapon 40, although other arrangements are known and used. While shotguns 40 are typically equipped with internal threads for the purpose of mounting a choke, these will only allow a very thin walled section of metal to intrude into the barrel 32.

A more durable and robust mounting arrangement, when desired, is effected via external threads (not illustrated) disposed outside of the muzzle 33 and adapted to mate to internal threads 21 disposed in the end cap 15. While either arrangement may be usefully employed, the illustrations and discussion contained herein are in terms of this thread arrangement, for clarity of illustration and ease of understanding. This might typically comprise a threaded section having 18 to 40 threads per inch disposed therein.

In one embodiment, this coupling was effected by machining the muzzle end 33 of a barrel to provide a one inch long cylindrical section having a uniform outside diameter of about one inch. A piece of 4140 steel was machined to have a length of about one inch, and an inside diameter of about one inch, i.e., to have an inside diameter comparable to the outside diameter of the machined barrel section. The forward portion of the 4140 steel (e.g., the first 0.875 inch) was machined to have an outside diameter of 1.125" and the rear portion was machined to have an outside diameter of about 1.375". Threads were machined onto the portion having an outside diameter of 1.125" and the composite assembly was tungsten-inert-gas or TIG welded to the Cr:Mo barrel material. This provides a robust muzzle 33, reducing stress on the barrel due to the mass of the suppressor 11, which in this prototype weighed about eight pounds. This also reduces probability of fracture of the muzzle 33 during normal use.

As used herein, the term "permanently attached" is used in the same sense as it is used by the Bureau of Alcohol, Tobacco and Firearms ("BATF"). The definition employed by BATF recognizes only three forms of permanent attachment for purposes of tax evaluation: (i) blind pinning (attachment to a barrel by metal pins, the head of each pin being below the surface of the attachment and covered by weld material); (ii) high temperature silver soldering at a temperature of 1100 degrees Fahrenheit or more and (iii) electric welding.

The outer shell 13 has a diameter 20 that is large enough to accommodate both a passage of the same diameter as the bore of the weapon that the suppressor 11 is intended to adapt to and to include expansion chambers distributed along a length of barrel contained therewithin. The outer shell 13 also includes internal threads 29 for threadedly engaging external threads 29' disposed about the periphery of end caps 15 and 17. This effectuates a rugged coupling of the end caps 15 and 17 to the outer shell 13 of the suppressor 11.

The outer shell 13 also usefully includes provisions for allowing sights, such as rear sight 16 and front sight 16', to be mounted thereto. Rear sight 16 and front sight 16' may be sights including tritium sights ("shotgun beads") such as those manufactured by Meprolight of Israel for convenience in operation of the shotgun 40 (see FIG. 4, infra) with the suppressor 11 coupled thereto, under conditions of reduced illumination, such as at night.

FIG. 2 is a simplified side view, in section, taken along section lines II—II of FIG. 1, of a portion 23 of the first preferred embodiment of the suppressor 11, in accordance with the teachings of the instant invention. The portion 23 illustrates a series of cone-shaped baffles 27 disposed along the length 12 of the suppressor 11, forming a series of chambers, generally isolated one from the other and coupled to the bore of the suppressor 11 via a collection of small openings 31 disposed in barrel segments 24 coupled to the cone-shaped baffles 27.

In one embodiment of the instant invention, the barrel segments 24 are fashioned from a single piece of material and form a continuous barrel segment 24 extending from a first of the end caps 15 to a second of the end caps 17, as exemplified by the barrel segment 24 shown extending past multiple baffles 27, in the right hand side of FIG. 2. In another embodiment, the barrel segments 24 comprise two or more pieces of material and may be fashioned from different materials. For example, a first barrel segment 24 may include one or more of the funnel-shaped baffles 27 and may be made from a durable material such as steel. A subsequent barrel segment 24 may include one or more of the baffles 27 and may be formed from a lighter weight material such as aluminum. In this way, the initial barrel segment 24 is able to contain the higher pressures encountered at that point in the path 12 of the advancing shot, while the overall weight of the suppressor 11 is reduced over what would have been required had the entire suppressor 11 been manufactured from steel, for example.

In one embodiment of the instant invention, the barrel segments 24 resemble funnel necks coupled to the baffle elements 27. In one preferred embodiment of the instant invention, each of cone-shaped baffles 27 and barrel segments 24 comprise single pieces of material resembling a funnel. In other words, each cone-shaped baffle 27 includes an attached barrel segment 24.

The composite assembly 30 (see FIGS. 3A and 3B, infra) is usefully fashioned from a single piece of material, such as Cr:Mo 4140 steel, 303 stainless steel or 316 stainless steel. Aluminum can be used after the first or later baffles because pressures at that point have been significantly reduced. The first or first several baffles 27 and bore segments 24 function as blast plates and are expected to experience higher pressures than subsequent baffles 27 and bore segments 24. It will be appreciated that the baffles 27 may be realized with shapes differing from that depicted, such as discs, reverse funnels etc., as long as the result is a series of chambers, largely decoupled from each other, each of which is coupled to the bore of the suppressor 11 via a series of openings such as openings 31.

In one preferred embodiment of the instant invention, the baffles 27 are equipped with flanges 27" disposed at the outer periphery of the baffles 27. The flanges 27" provide a seat for the optional support pieces 28. The optional support pieces 28 comprise, e.g., cylinders adapted to nest within the outer shell 13, and the support pieces 28 mate with the flanges 27" to provide continuous mechanical support for the baffles 27 along the length 12 of the suppressor 11.

The baffles 27, the optional flanges 27", the optional support pieces 28, the barrel segments 24 and the end caps 15 and 17 collectively cooperate (when present) to maintain alignment of the baffles 27 and the barrel segments 24 coaxially with the bore of the shotgun 40 (see FIG. 4 and associated text). When the optional flanges 27" and the optional support pieces 28 are employed, they desirably form a continuous support structure extending along the entire length of the suppressor between the end caps 15 and 17.

The bore 18 of the suppressor 11 is sized to accommodate the barrel and projectiles suitable to the bore of the shotgun 40 to which the suppressor 11 is intended to be coupled. Bore diameters for different popular gauges of shotgun are summarized below in Table I.

TABLE I

Bore diameters for different shotgun gauges.

| Gauge | 10 | 12 | 16 | 20 | 28 | 410 |
|---|---|---|---|---|---|---|
| Size | .775" | .725" | .665" | .615" | .545" | .410" |

In another preferred embodiment the suppressor 11 (FIG. 1) includes barrel segments 24 fashioned from a length of, for example, shotgun barrel 32 (see FIG. 4, infra) such that the barrel segments 24 form a continuous piece of material extending largely along the length (as indicated by direction arrow 12) of the suppressor 11. In this embodiment, the baffles 27 are adapted to slip over the modified barrel segments 24 and are usefully contained in spaced relation to each other by the outer shell 13, the flanges 27", the support pieces 28 and the end caps 15 and 17.

FIG. 3A is a simplified side view, in section, taken along section lines II—II of FIG. 1, of a portion 30 of the suppressor 11, showing details of the first preferred embodiment of the suppressor, in accordance with the teachings of the present invention. The portion 30 includes portions 27' of the baffles 27 (see FIG. 2, supra) coupled to the barrel segments 24 and shows the openings 31 in more detail.

The openings 31 have a length 31', measured along the length of the bore (as shown by direction arrow 12), and a width 31", measured transverse to the bore (perpendicular to direction arrow 12), adapted to obstruct passage of the shot pellets 63 (see FIG. 6, infra) through the openings 31, but also adapted to permit passage of gasses and combustion products through openings 31, reducing muzzle blast from the weapon 40 (see FIG. 4) when it is discharged. The openings 31 cannot admit or pass the shot pellets 63 if either or both of dimensions 31' and 31" are smaller than the diameter of the shot pellets 63.

Prior art suppressors have incorporated large effective openings to the chambers of the suppressor, which leads to debunching of the shot 63, collision of the shot 63 with the baffles 27 and subsequently the outer shell 13 and tends to result in the destruction of the suppressor 11. This is undesirable, particularly if it results in shrapnel that could injure the operator of the weapon or others nearby. Prior art suppressors generally have failed to provide adequate performance in adaptation to shotguns 40, as noted in U.S. Pat. No. 5,479,736, entitled "Augmented Service Pistol And Ammunition Weapons System" and issued to Forrester (see col. 1, lines 55–56).

The openings 31 are optimally either orthogonal to the walls of the barrel segments 24 or are tilted such that the rearward wall 41' (i.e., the wall closest to the stock) forms an acute angle of intersection $\theta_1$ with the intended path of the projectile (see direction arrow 12) while the forward wall 41 (i.e., the wall closest to the muzzle) forms an obtuse angle of intersection $\theta_1$ with the intended path of the projectile, as illustrated in FIG. 3B. FIG. 3B is a side view, in section, taken along section lines IIIB—IIIB of FIG. 3A, of portion 30' and FIG. 3B illustrates the preferred range of angles of intersection $\theta_1$ of the openings 31 in the barrel segments 24 with the forward wall 41 and the rearward wall 41' of the barrel segments 24.

The preferred range of angles of intersection $\square_1$ and $\square_2$ extends from about 90° to about 30° or less. It is generally undesirable to have an acute angle of intersection $\square_2$, because then the edges of the openings 31 may tend to cause erosion of the wadding 72, the cup 74 and/or the optional end cap 76 containing and protecting the shot 63 (see FIG. 6, infra) as it travels through the barrel segments 24. It will be appreciated that the angles of intersection $\theta_1$ and $\theta_2$ need not be supplementary but that such a relationship may be an artifact of the methods employed to create the openings 31.

Obtuse angles of intersection $\theta_1$ are preferred because they tend to adapt the pressure of the expanding gasses to provide anti-recoil forces. This arises because the pressures provided by the expanding gasses on the forward face 41 are greater than the pressures provided on the rearward face 41', even when the angles of intersection $\theta_1$ and $\theta_2$ are chosen to be 90° (because of the spatial relationship each wall 41, 41' has with the expanding gasses), and this tends to provide forward thrust for the suppressor 11, in opposition to the recoil forces generated by discharge of the weapon to which the suppressor 11 is attached. By providing a series of openings 31 that are distributed over a greater length of the barrel 32 than is the case with prior art recoil compensation devices, a moreeffective anti-recoil mechanism is provided.

In one preferred embodiment of the instant invention, the barrel segments 24 include chamfered ends 14 and 14' designed to nest together, such that the projecting portion of the chamfered end 14 of a first barrel segment 24 nests within the receptacle portion 14' of the subsequent barrel segment 24. This arrangement is further designed such that the projecting portion of the chamfered end 14 of the first barrel segment 24 is compressed into the receptacle portion of the chamfered end 14' of the second barrel segment 24 when the shot 63 passes through the series of barrel segments 24. It will be appreciated that other arrangements for employing the forces that naturally act on the barrel segments 24 to maintain their alignment may be usefully adapted for use with the instant invention.

For example, a spline fit between portions 14, 14' is but one of the many ways in which the barrel segments 24 may be maintained in spaced relation and in alignment with the bore of the shotgun 40 (see FIG. 4, infra). It is strongly desirable to maintain the integrity of the bore throughout the length of the suppressor 11, and the walls of the segments 24 must be of sufficient thickness 25 to preserve the segments 24 in their intended use, despite the presence of the openings 31.

Additionally, a portion of the chamfered end 14 desirably includes a reversed chamfer 14". This is to avoid erosion of the wadding 72, the cup 74 and/or the optional end cap 76 containing and protecting the shot 63 (see FIG. 6, infra) as it travels through the barrel segments 24. Desirably, the reverse chamfered region 14" is on the order of a millimeter long.

In a preferred embodiment of the instant invention, the openings 31 are symmetrically disposed in groups of twelve (i.e., every 30°) about the circumference of the barrel segments 24. In this embodiment, the openings 31 are usefully chosen to have a width 31" of 5/32" and a length 31' of 0.5". When this geometry is employed for the openings 31, together with 1/8" of relief at either end of the openings 31, the total length of each of the barrel segments 24 is about 0.75".

FIG. 3C is a simplified side view, in section, taken along section lines II—II of FIG. 1, showing details of a second preferred embodiment 30" of the modified barrel segments 24 and a blast plate for the suppressor 11, in accordance with the teachings of the present invention. The modified barrel segments 24 include flanges 14A and 14B disposed at either end and adapted to mate with successive modified barrel segments 24.

Also illustrated in FIGS. 2 and 3C is a different arrangement of openings 31A. The openings 31A usefully comprise holes having a diameter of about one-eighth of an inch and spaced apart by a center-to-center distance of about three-eighths of an inch, although larger or smaller openings 31A and spacings may also be usefully employed.

In one embodiment of the instant invention, the first or the first few barrel segments 24 and baffles 27A are fashioned as shown in FIG. 3C (and FIG. 2) and these are fashioned from steel having a thickness 25 of about 0.125", while subsequent barrel segments and baffles 27 or 27" (e.g., as illustrated in FIG. 3A) are fashioned from aluminum, with these barrel segments incorporating a wall thickness 25 of, for example, 0.190".

FIG. 3D is a simplified side view, in section, taken along section lines IIID—IIID of FIG. 3C, illustrating a preferred embodiment 30A of the flanges 14A and sockets 14B for mating successive barrel segments 24 to one another, in accordance with the teachings of the instant invention. The flanges 14A are adapted to fit snugly into the sockets 14B in response to pressure from the end caps 15 and 17.

A suppressor 11 using these designs and, for example, eleven barrel segments 24 and baffles 27, could have an overall length of about eight to nine inches and a diameter 20 of about two to two and one-half inches or more. Suppressors 11 as described are useful in conjunction with shotguns 40, as described in association with FIG. 4, for suppressing muzzle blast, recoil and/or muzzle jump.

FIG. 4 is a simplified schematic illustration of a shotgun 40 in accordance with the teachings of the instant invention. The shotgun 40 includes an optional buttstock 37, trigger assembly 36, firing assembly 35, rear sight 16, barrel 32 having acceleration portion 34–34', travel portion 34", muzzle 33 and front sight 16'. In operation, the shotgun 40 detonates a shell 50 (see FIG. 5, infra) in the chamber (not illustrated) located within or near firing assembly 35. The shot 63 (see FIG. 6, infra) does not immediately begin to move; rather, the powder 71 (see FIG. 6, infra) burns, producing a large amount of gas within the small volume of the chamber. This results in substantial chamber pressure.

Peak chamber pressures of about 55,000 pounds per square inch are achieved in some rifles, however, peak chamber pressures of about 12,500 pounds per square inch are more common in shotguns. The peak chamber pressure and the bulk of the acceleration of the shot 63 are achieved while the shot 63 is still very close to the chamber, i.e., within the acceleration portion 34–34' of the barrel 32.

Travel portion 34" of the barrel 32 serves to "focus" the shot 63, with weapons that include relatively little travel portion 34" producing wider scatter of the shot 63 at closer distances than shotguns 40 that include relatively longer travel portions 34". This focus is also affected by chokes that are often coupled to the muzzle 33 of the shotgun 40.

FIGS. 1 through 3 and associated text describe a suppressor 11 that mitigates the effects of muzzle blast. The sound that otherwise results from escape of gasses from the muzzle 33 of a shotgun 40 when it is discharged is substantially reduced in volume when a device such as the suppressor 11 is used in conjunction with the shotgun 40. However, this does not necessarily affect muzzle crack substantially.

By combining a suppressor 11 with a short-barreled shotgun 40, i.e., a shotgun 40 having a barrel 32 with the muzzle placed in the acceleration region (i.e., between 34 and 34'), the openings 24 in the suppressor 11 have opportunity to reduce peak chamber pressure and hence to influence muzzle velocity. This may allow reduction of both muzzle blast and muzzle crack without necessarily requiring modification of the shotgun shell 50 (see FIGS. 5 and 6, infra) that is fired from the shotgun 40. This combination of features provides a weapon 40 that is ideally suited to certain types of police work requiring deadly force at short range together with as little noise as possible.

A problem with shotguns deploying shot loads is associated with the tendency of shot loads to spread as the load travels over a deployment trajectory. This tends to reduce the amount of shot impacting targets that are not immediately adjacent the muzzle of the shotgun, i.e., tends to reduce payload efficiency. In turn this reduces (i) the mass, momentum and energy delivered to the target, (ii) reduces the overall range of the shotgun and (iii) increases the probability of striking something or someone other than the intended target. On the other hand, deer slugs and sabots do not have these problems, but may present over-penetration hazards.

In many situations, the decrease in payload efficiency as the shot travels over the deployment trajectory is advantageous. These are often situations where a stray solid projectile may travel a long distance and then strike a target with lethal force. In the crowded apartment scenario (described above), it is extremely likely that any projectile will strike a wall, window, ceiling, floor, door, target, appliance etc. within a very short distance from discharge of the muzzle. In many other settings, the relative positions of the target and surrounding features also guarantee a high probability of short unimpeded flight of the projectile.

Thus, in some settings, it is highly probable and immediately predictable that it is highly advantageous to be able to deploy lethal force having reduced over-penetration. A frangible shotshell that disintegrates upon first impact can provide these advantages. As used herein, the term "frangible" is used to mean a projectile that maintains projectile integrity prior to impact (i.e., the projectile stays in one piece prior to impact) and that does not maintain projectile integrity after impact.

The muzzle velocity can also be modified by alterations to the shotgun shells 50, 60. This is described in conjunction with FIGS. 5 and 6.

Figure 5:
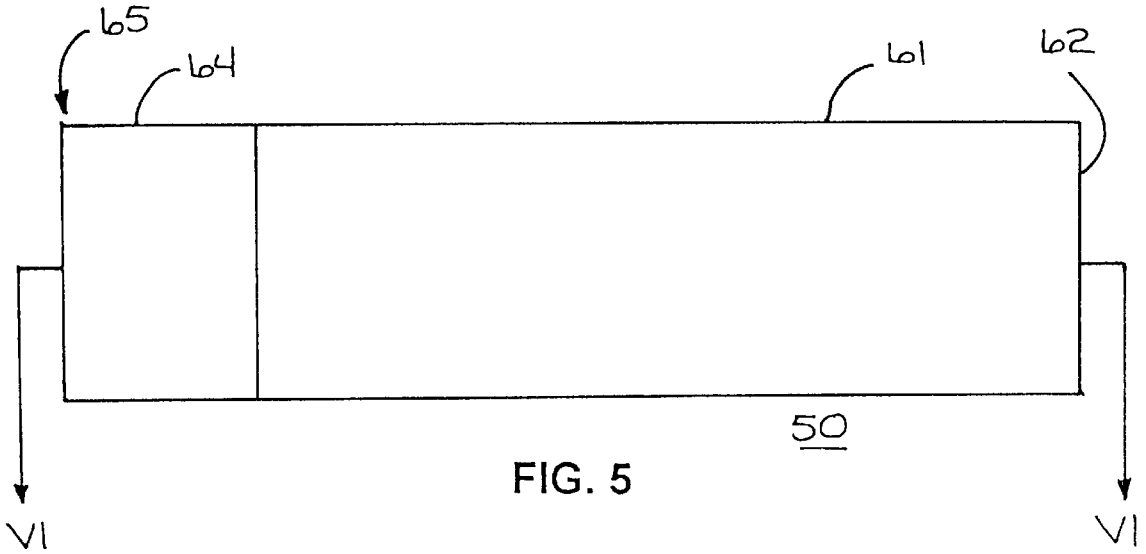
FIG. 5 is an enlarged and simplified side view of a shotgun shell, in accordance with an embodiment of the instant invention.

FIG. 5 is an enlarged and simplified side view of a shotgun shell 50, in accordance with the teachings of the instant invention. The shotgun shell 50 includes a metal portion 64, typically fashioned from brass and including a lip 65. The lip 65 facilitates ready ejection of spent shells 50 from the shotgun 40 (see FIG. 4). The shotgun shell 50 also includes an outer casing 61, which is usually made of plastic but that may be made from metal or paper. The outer casing 61 is typically crimped at one end 62 to contain the shot 63 (see FIG. 6) and wadding 72.

Figure 6:
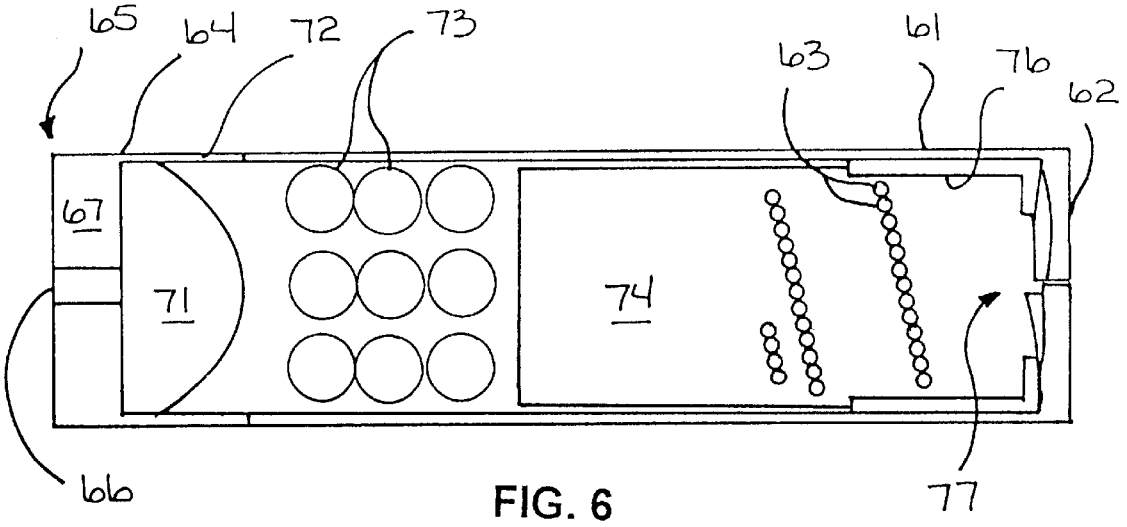
FIG. 6 is an enlarged and simplified side view, in section, taken along section lines VI—VI of FIG. 5, of a shotgun shell, in accordance with an embodiment of the instant invention.

FIG. 6 is an enlarged and simplified side view, in section, taken along section lines VI—VI of FIG. 5, of a portion 60 of a shotgun shell 50, in accordance with the teachings of the instant invention. FIG. 6 illustrates a battery cup 66 centrally disposed in the brass 67 of the brass head 64. The battery cup 66 contains the primer and initiates the combustion of the powder 71 disposed between the brass head 64 and the wadding 72 when the shotgun 40 is discharged.

The wadding 72 includes openings 73, which allow for compression of the wadding 72 when the end 62 is crimped. The wadding 72 serves to contain the burning gasses and to seal the barrel opening during discharge of the weapon 40. The wadding 72 also includes a cup 74 filled with shot 63. The shot 63 is manufactured and is readily obtainable in a variety of sizes as summarized below in Table II.

TABLE II

Shot sizes for shotguns.

| Size | 9 | 8 | 7.5 | 6 | 5 | 4 | 2 | BB |
|---|---|---|---|---|---|---|---|---|
| Dia. | .08" | .09" | .095" | .11" | .12" | .13" | .15" | .18" |
| Size | No. 4 buck | No. 3 buck | No. 2 buck | No. 0 buck | No. 00 buck | | | |
| Dia. | .24" | .25" | .30" | .32" | .33" | | | |

The dimensions discussed above in conjunction with FIGS. 3A and B for openings 31 are consistent with usage of shot 63 down to at least number two shot. Smaller openings 31 (i.e., having a narrower width 31", see FIG. 3A) are generally consistent with usage of shot 63 comprising pellets having smaller diameters.

Additionally, the present invention contemplates usage of a cup 76 disposed around the leading edge of the shot 63 and having an opening 77 disposed at the leading edge of the cup. In a preferred embodiment, the opening 77 is centrally located on the cup 76.

In operation, the cup 76 contains the shot 63 during passage through the barrel 32 and the suppressor 11, even when the shot 63 has dimensions smaller than those 31', 31" of the openings 31 (see FIG. 3A). Upon exiting from the end cap 17 of the suppressor 11, the opening 77 is intended to force separation of the cup 76 from the mass of shot 63 by allowing air pressure to be built up within the cup 76 and/or by allowing the shot 63 to pass through the opening 77 in response to air drag on the cup 76.

In an alternative embodiment, the shot 63 is usefully contained in a plastic or vinyl container. Preferably, the plastic or vinyl container is sealed until the shot 63 and container impacts a target. This obviates a cracking noise that is heard when separate petals of a conventional shotgun shell cup 76 slap back in response to the air pressure exerted against the moving shot load 63. In one embodiment, the shot is maintained in a mass by adding organic material to the shot and then baking the resulting composition to form a solid or semi-solid mass.

There are three basic ways to vary the muzzle velocity achieved when a shotgun 40 is discharged. When the mass of the shot 63 is increased, the muzzle velocity drops. When the dram equivalent of the powder 71 is reduced (e.g., by using less powder or a less combustible powder), the muzzle velocity drops. When the chamber pressure is reduced (e.g., by bleeding some of the combustion products from the chamber via an orifice), the muzzle velocity drops.

In order to eliminate muzzle crack, the muzzle velocity must be less than Mach 1, i.e., less than the speed of sound in air or less than about 760 miles per hour (about 1100+ feet per second). Most shotgun shells 50 are intended to provide muzzle velocities of between just over Mach 1 and Mach 2, in the range of 1150 to 1300 or 1400 feet per second, although higher velocities are not uncommon.

Muzzle velocity may be reduced to 1100 feet per second or less by (i) reducing the amount of powder 71 contained in the shell 50, (ii) increasing the mass of shot 63 contained in the shell 50 and/or (iii) bleeding some of the combustion products from the chamber via a small orifice. Methods (i) and (ii) require specially-manufactured shotgun shells 50, 60 while method (iii) requires permanent modification of the shotgun 40.

For example, a shotgun shell 50 prepared with 23 grains of Winchester 540 powder and loaded with one and one-half ounces of No. 4 shot (dia.=0.13") provides a muzzle velocity of about 1050 feet per second (i.e., less than Mach 1) when fired through a shotgun 40 having a barrel 32 of nine inches in length. Shotguns 40 originally manufactured with overall lengths of less than 26.5" or barrel lengths of less than 18" are required to be registered with BATF via procedures that BATF or suitable weapons dealers are familiar with. Barrel lengths of at least eight to nine inches are necessary in order to accommodate pump actions on pump style shotguns 40.

Methods for reducing or ameliorating both muzzle blast and muzzle crack in shotguns deploying shot loads have been described. Muzzle blast is reduced by coupling a series of chambers to the barrel in such a fashion that the shot load cannot escape from the barrel. Muzzle crack is reduced by reducing the muzzle velocity below that of the speed of sound. This is achieved by reducing the effective amount of powder or the peak chamber pressure or by increasing the mass of the shot load.

Figure 7:
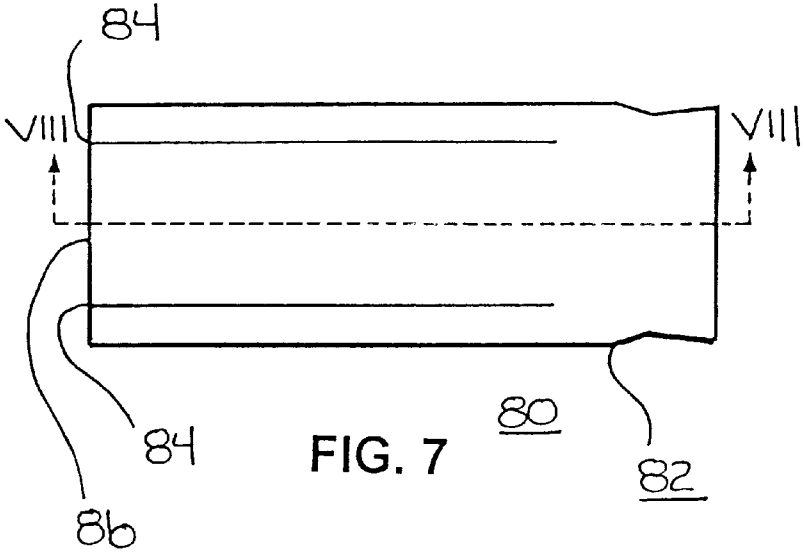
FIG. 7 is an is an enlarged and simplified side view of a portion of a shotgun shell, in accordance with an embodiment of the instant invention.

FIG. 7 is an enlarged and simplified side view of a portion 80 (or wad 80) of a shotgun shell, in accordance with an embodiment of the instant invention. In one embodiment, the portion 80 includes a cup-shaped body 82 that is formed from high density polyethylene. Such cup-shaped bodies 82 are commercially available under the name "Steel Tuff" from Precision Reloading, P.O. Box 122, Stafford Springs Conn. 06076-0122, tel. (800) 223 0900 (part no. TUFW123 for 3" and TUFW 1235 for 3.5"). The cup-shaped body 82 is predivided by slits 84 into a series of petals 86 (e.g., four petals) that separate following normal discharge from a muzzle, causing increased drag and encouraging the cup-shaped body 82 to separate from the payload.

Figure 8A:
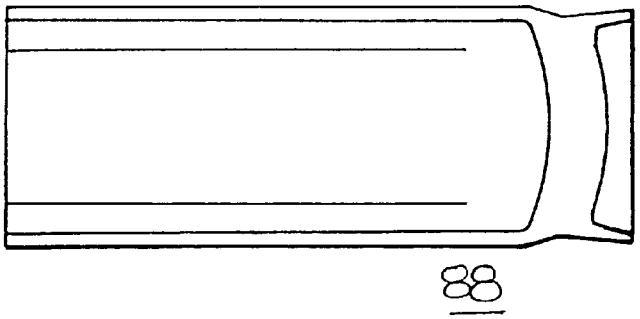
FIGS. 8A–8C are simplified side views, in section, taken along section lines VIII—VIII of FIG. 7, of a portion of the shotgun shell of FIG. 7, in accordance with an embodiment of the instant invention.
Figure 8C:
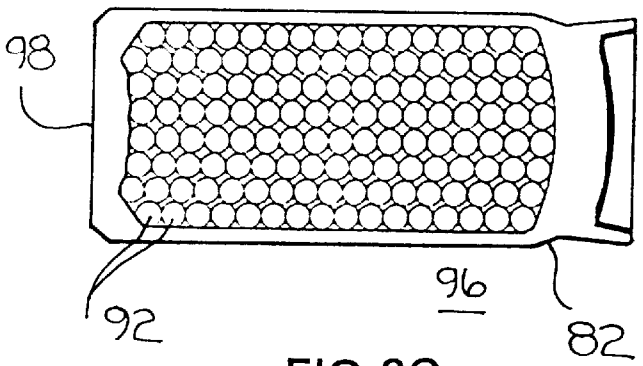
Figure 8B:
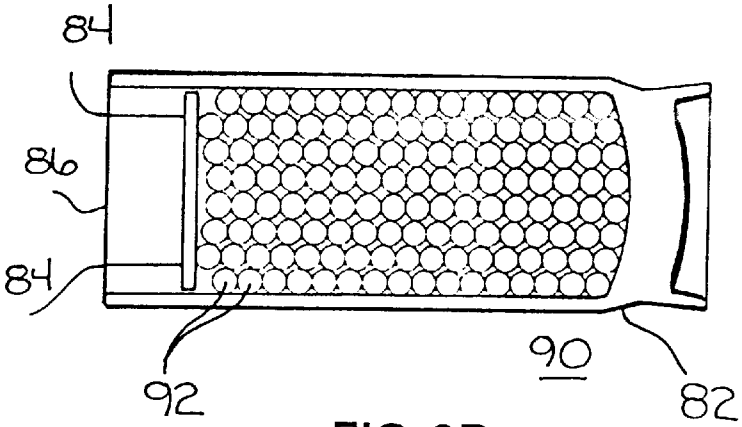

FIGS. 8A–8C are simplified side views, in section, taken along section lines VIII—VIII of FIG. 7, of a portion 88 of the cup-shaped body 82 of FIG. 7, in accordance with an embodiment of the instant invention. FIG. 8A shows the portion 88 in cross-section.

FIG. 8B shows a shotshell payload 90 including a quantity of shot 92 enclosed in the body 82 together with an end cap 94. In one embodiment, the end cap 94 has a thickness of about forty to sixty thousandths of an inch, a diameter of about 0.625" to 0.649" and may be formed from low or high density polyethylene or other plastic. In one embodiment, the body 82 includes about 660 grains of no. 9 shot, providing a payload mass of about 720 grains.

FIG. 8C is a simplified side view, in section, taken along section lines VIII—VIII of FIG. 7, of a completed frangible payload 96. Ends of the petals 86 and the low density polyethylene end cap 94 have been fused using heat to provide a compact and rigid payload 96 that disintegrates following firing from a shotgun and impact. As a result, the payload provides great potential lethality prior to impact and relatively quick dissipation of the payload 96 following impact.

It will be appreciated that a broad variety of payloads formed from conventional prefragmented material are possible, and that these may include, for example, shot, flechettes and shot joined by wires. When the mass of the payload 92 is chosen together with a suitable quantity of powder, a subsonic frangible shotshell is realized.

One measure of traumatic capability for a round is found by multiplying the mass of the projectile by the velocity of the projectile. For example, a standard 0.45 caliber 230 grain round traveling at 760 feet per second corresponds to a momentum product of 174,000. This is considered a "major" impact.

When loaded as described above, the frangible shotshell results in a 720 grain projectile traveling at about 1000 feet per second and includes about 4.4 times the momentum of the standard 0.45 caliber round. The energy delivered to the target, which increases as the square of the velocity, is about six times that of the standard 0.45 caliber round, i.e., corresponds to a high degree of lethality on impact. At the same time, over-penetration is avoided, because the payload disintegrates at first impact and is quickly dissipated following disintegration. The payload velocity is subsonic, allowing the payload to be deployed relatively quietly when the suppressors of the instant disclosure are employed. This combination of features presents profound advantages for law enforcement personnel in the crowded apartment building scenario described earlier.

When impacting a target, the payloads of FIGS. 5–8 can deliver the energy equivalent of six 0.45 caliber rounds in an area having a diameter of about three-fourths of an inch when propelled by 19.8 grains of Winchester Super Field smokeless powder as measured by a MEC #20 powder bushing. When this combination is used, the payload is traveling at a speed of about 1025 feet per second, i.e., subsonically. These kinds of payloads are also useful when the payload mass is reduced, or the amount of gunpowder is increased, or both, to make the payload supersonic. This can result in greater momentum and energy transfer to the target together with increased range compared to normal shot loads.

Thus, a suppressed payload deployment is possible with high lethality and low probability of overpenetration that also provides increased range for shot loads in situations where the projectile is unlikely to suffer impact prior to achieving the target.

Figure 9:
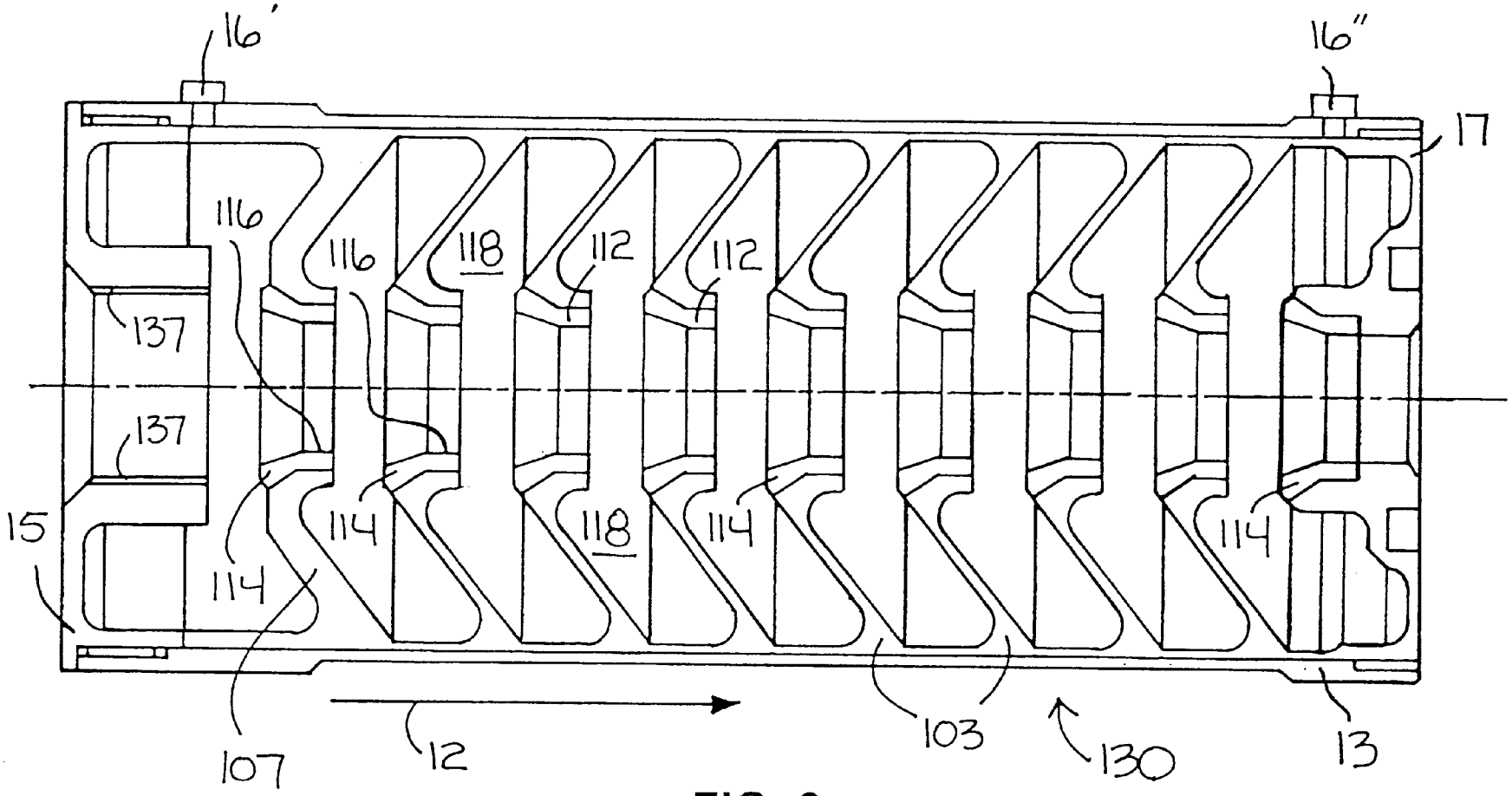
FIG. 9 is a simplified side view, in section, taken along section lines II—II of FIG. 1, of another embodiment of the suppressor, in accordance with the teachings of the instant invention.

FIG. 9 is a simplified side view, in section, taken along section lines II—II of FIG. 1, of another embodiment of the suppressor, in accordance with the teachings of the instant invention. The embodiment illustrated in FIG. 9 includes end caps 15 and 17 coupled to an exterior shell 13, however, the baffles 103 and the blast plate 107 differ in design and concept from those of the earlier-described embodiments.

The baffles 103 and the blast plate 107 are fashioned, in one embodiment, from an aluminum outer ring 110 coupled to a steel inner ring 112. The baffles 103 and blast plate 107 are spaced so that two or more of the steel inner rings 112 are in contact with the shot load as it is being deployed, i.e., act as barrel segments. This serves two functions: (i) the shot load prevents burning or burnt propellant gasses from escaping through the suppressor 100 and (ii) the shot load is maintained in line with the openings in the inner rings 112.

In one embodiment, the inner rings 112 may be constructed to include a first tapered section 114 and a second, non-tapered section 116. The first, tapered section 114 serves to maintain the shot load in the central portion of the suppressor. The second, non-tapered section 116 serves to support the shot load and to maintain a pressure seal to prevent the burning propellant from escaping around the shot load.

Construction of the baffles 103 to provide large spaces 118 between the baffles allows the burning propellants to be expelled into the cavities or chambers between the baffles 103. The burning and burnt propellants then exit from these chambers after the shot load has exited from the suppressor 100, with substantially less report than is normally the case.

It will be appreciated that the functions of the inner and outer rings may be combined in one integral piece of metal, either a light and strong metal (e.g., titanium) where weight is at a premium, or a strong metal, such as steel, where weight is not an issue.

In either case, spaces between the baffles 103 may be filled with a material that allows the heat from the burning or burnt gasses to be dissipated, and that tends to introduce additional barriers to escape of gasses. Examples of such materials can include fiberglass or copper wool. Copper wool is commercially available under the ChoreBoy brand name.

Figure 10:
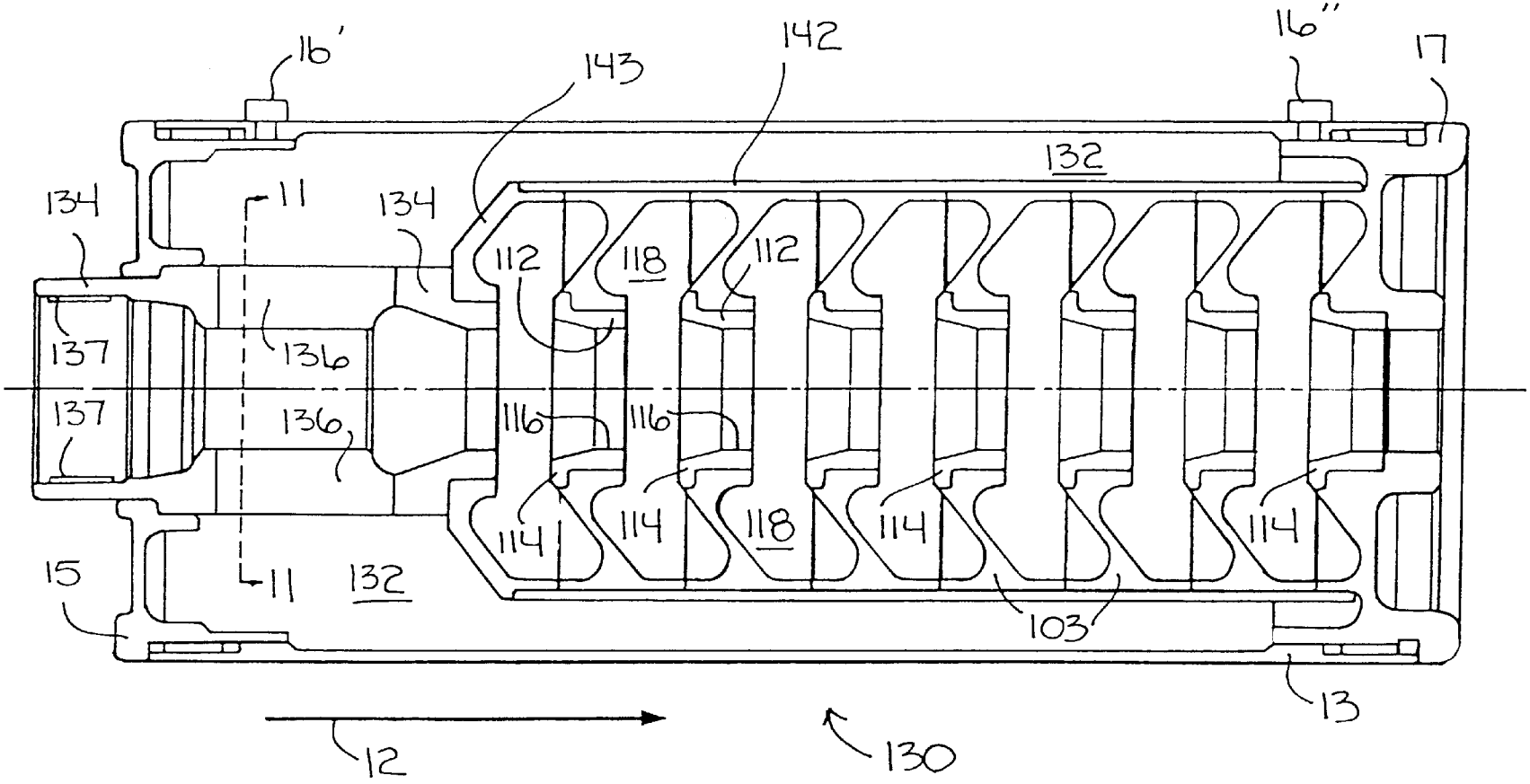
FIG. 10 is a simplified side view, in section, taken along section lines II—II of FIG. 1, of another embodiment of the suppressor.

FIG. 10 is a simplified side view, in section, taken along section lines II—II of FIG. 1, of another embodiment of the suppressor, in accordance with the teachings of the instant invention. The embodiment of FIG. 10 is similar to that of FIG. 9 in some respects, however, an additional cavity 132 is included that is coupled to the bore through a different type of blast plate 134. The blast plate 134 includes openings 136 that may be slots cut through a neck 138 of the blast plate 134.

Figure 12:
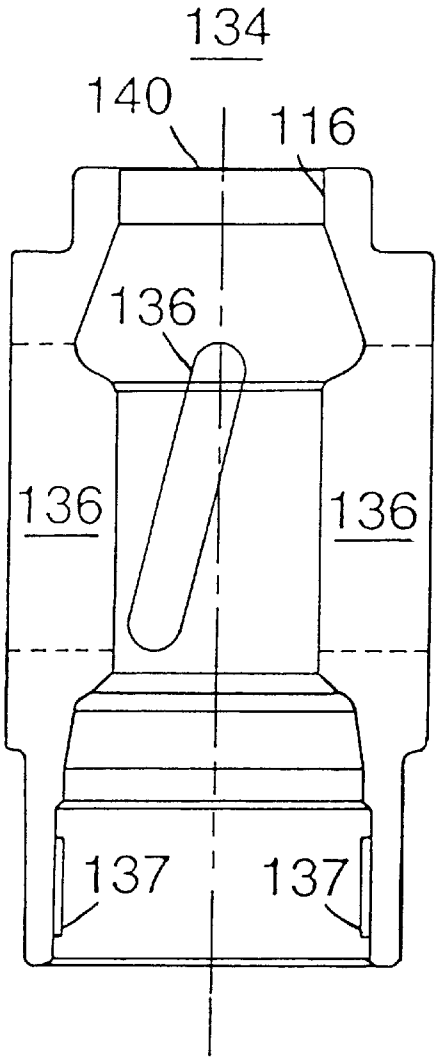
FIGS. 11 and 12 are detailed views of portions of the embodiment of FIG. 10, in accordance with the teachings of the instant invention.
Figure 11:
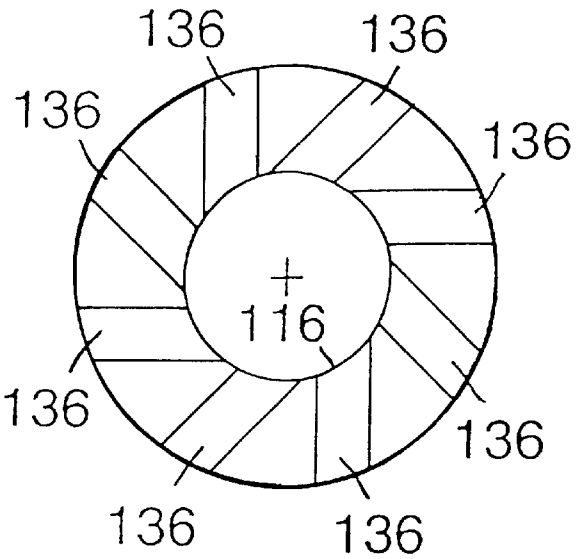

In one embodiment, where the end cap 15 is adapted to be secured to the muzzle via threads 137, the openings 136 may be angled (see FIG. 11, a sectional view taken along section lines 11—11 of FIG. 10, showing eight openings 136, although more or fewer may be employed) such that escaping propellant will cause pressures on the blast plate 134 that tend to tighten the threads 13 coupling the suppressor 130 to the muzzle of the weapon to which the suppressor 130 is attached. The openings 136 may be offset from the centerline in a manner that promotes the swirling of propellant gasses in a common direction, i.e., clockwise or counterclockwise. The openings 136 may also be formed at an angle to the direction of travel 12 of the shot, as shown in FIG. 12.

In one embodiment, the openings are inclined at an angle of 45 degrees from the direction 12 to further promote swirling of propellant gasses. In one embodiment, an end 140 of the blast plate 134 distal from the muzzle forms a closed ring, i.e., the slots 136 do not extend to the end 140, to provide support for the inner can 142 of FIG. 10.

In one embodiment, the slots 136 are made to have a width of 3⁄16" and a length of less than one inch. The blast plate 134 may be made to have an outer diameter of 1.49" and an inner diameter of 0.73" to accommodate 12 gauge shot.

The inclusion of a first chamber 132 that is allowed to encompass the remainder of the suppressor is a type of suppressor 130 that is known as a "can in can" suppressor. The initial expansion chamber 132 serves a number of functions. A first function is that it allows the pressure of the burning propellant to be substantially reduced, by providing a large volume into which it can expand. A second is that it provides additional sound insulation between the subsequent baffles 103 and the area outside of the suppressor 130.

Experimental use shows that additional cooling of the burning propellant is possible by inclusion of a small amount of water in the suppressor 11, 100 or 130. This may be effected by wetting the components prior to assembly.

In the embodiments shown in FIGS. 9 and 10, the inner ring 114 may be made slightly oversize with respect to the openings in which they are seated in the outer ring 112. By heating the outer ring on a hot plate to a temperature of, for example, 100 to 300 degrees Centigrade, and cooling the inner ring 114, the inner ring 114 may be slipped into the opening in the outer ring 112. The inner ring 114 may be cooled, for example, by immersing the inner ring 114 in an isopropyl alcohol bath that also contains dry ice. A DELRIN plastic rod of the appropriate diameter may be inserted into the opening 116 to handle the inner ring 114 and to insert the inner ring 114 into the outer ring in order to join the two. Typically, the inner ring 114 would be made to be approximately 0.001" to 0.003" larger than the opening into which it is to be seated.

In other embodiments, the inner ring 114 may be secured to the outer ring by any process now known or which is subsequently discovered. For example, the inner ring 114 could be secured to the outer ring 112 by pressing it into the outer ring 112 using great force. Alternatively, the inner ring 114 could be threaded into the outer ring 112. outer portions of the threads could be subsequently modified to prevent the inner ring 114 from becoming inadvertently detached. Pins could be employed to secure the inner ring 114 to the outer ring 112. Other forms of permanent or non-permanent attachment could be employed as well as is known to those of skill in the metalworking arts.

The foregoing detailed description of the instant invention for the purposes of explanation have been particularly directed toward suppression of long guns, such as rifles and shotguns. It will be appreciated that the invention is equally useful for suppressing other types of weapons, including pistols and the like. While Newton's laws do provide that for every action there shall be an equal and opposite reaction, the subject matter of the instant invention shows that the reaction or reactions may be modified to better suit the needs of persons operating weapons through appropriate choice of materials and construction techniques.

It will be appreciated that a system for suppressing muzzle blast and muzzle crack in shotguns, while increasing payload efficiency and reducing over-penetration, has been described that is readily and easily employed in conjunction with the operation of such weapons.

It will be appreciated that need for a suppressed shotgun has been described along with methods for meeting that need. Novel shotshells have been described that find application in suppressing muzzle blast in a variety of different types of weapons.

Various changes and modifications to the embodiment herein chosen for purposes of illustration will readily occur to those skilled in the art. For example, bore diameters, propellant quantities and shot size and total mass may be chosen as may be desired for a specific application. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A frangible shotshell payload comprising:

a cup having a portion divided into forwardly extending petals;

a payload having a plurality of elements disposed in the cup; and a cap disposed at, and fused to, tips of the petals to prevent separation of the petals upon firing and until impact.

2. The frangible shotshell payload of claim 1, wherein the cup comprises polyethylene.

3. The frangible shotshell payload of claim 2, wherein the cap comprises a disc of polyethylene having a diameter of 0.625".

4. The frangible shotshell payload of claim 2, wherein the cap comprises a disc of polyethylene.

5. The frangible shotshell payload of claim 1, wherein the cup comprises a cup for a 3" shotgun shell.

6. The frangible shotshell payload of claim 1, wherein the cup comprises a cup for a 3.5" shotgun shell.

7. A shotgun shell including:

a shell including propellant; and a frangible shotshell payload within said shell comprising:

a cup having a portion divided into forwardly extending petals;

a payload having a plurality of elements disposed in the cup; and a cap disposed at, and fused to, tips of the petals to prevent separation of the petals upon firing and until impact.

8. The shotgun shell of claim 7, wherein the payload comprises between 600 and 700 grains of prefragmented material and the base includes about 20 grains of propellant to provide a subsonic shotgun shell.

9. The shotgun shell of claim 7, wherein the cup comprises polyethylene.

10. The shotgun shell of claim 7, wherein the cap comprises a disc of polyethylene having a diameter of 0.625".

11. The shotgun shell of claim 7, wherein the cap comprises a disc of polyethylene.

12. The shotgun shell of claim 7, wherein the cup comprises a cup for a 3" shotgun shell.

13. The shotgun shell of claim 7, wherein the cup comprises a cup for a 3.5" shotgun shell.

* * * * *